United States Patent [19]

Gingerich et al.

[11] 4,236,482

[45] Dec. 2, 1980

[54] APPARATUS FOR APPLYING SEALING MATERIAL TO ENVELOPES

[75] Inventors: David L. Gingerich, San Bruno, Calif.; Robert Cohn, Omaha, Nebr.

[73] Assignee: Champion International Corporation, Stamford, Conn.

[21] Appl. No.: 914,035

[22] Filed: Jun. 9, 1978

[51] Int. Cl.[3] ..... B05B 5/00

[52] U.S. Cl. ..... 118/642; 118/239; 271/2; 271/198; 271/275

[58] Field of Search ..... 118/239, 642; 271/2, 271/198, 275

[56] References Cited

U.S. PATENT DOCUMENTS

| | | | |
|---|---|---|---|
| 2,410,611 | 11/1946 | Pratt et al. | 271/275 |
| 3,965,851 | 6/1976 | Cohn | 118/212 X |
| 4,050,412 | 9/1977 | Bautz | 118/642 |

*Primary Examiner*—Bernard D. Pianalto

*Attorney, Agent, or Firm*—Evelyn M. Sommer

[57] ABSTRACT

Independent conveyor belt systems each have a run overlapped with different portions of a run of a single endless belt to clamp an envelope therebetween to convey the envelope through successive sealing material applicator and drying stations. The belt systems enable feeding and removal of the envelopes from the same side of the apparatus and provide for compactness and portability of the apparatus.

7 Claims, 1 Drawing Figure

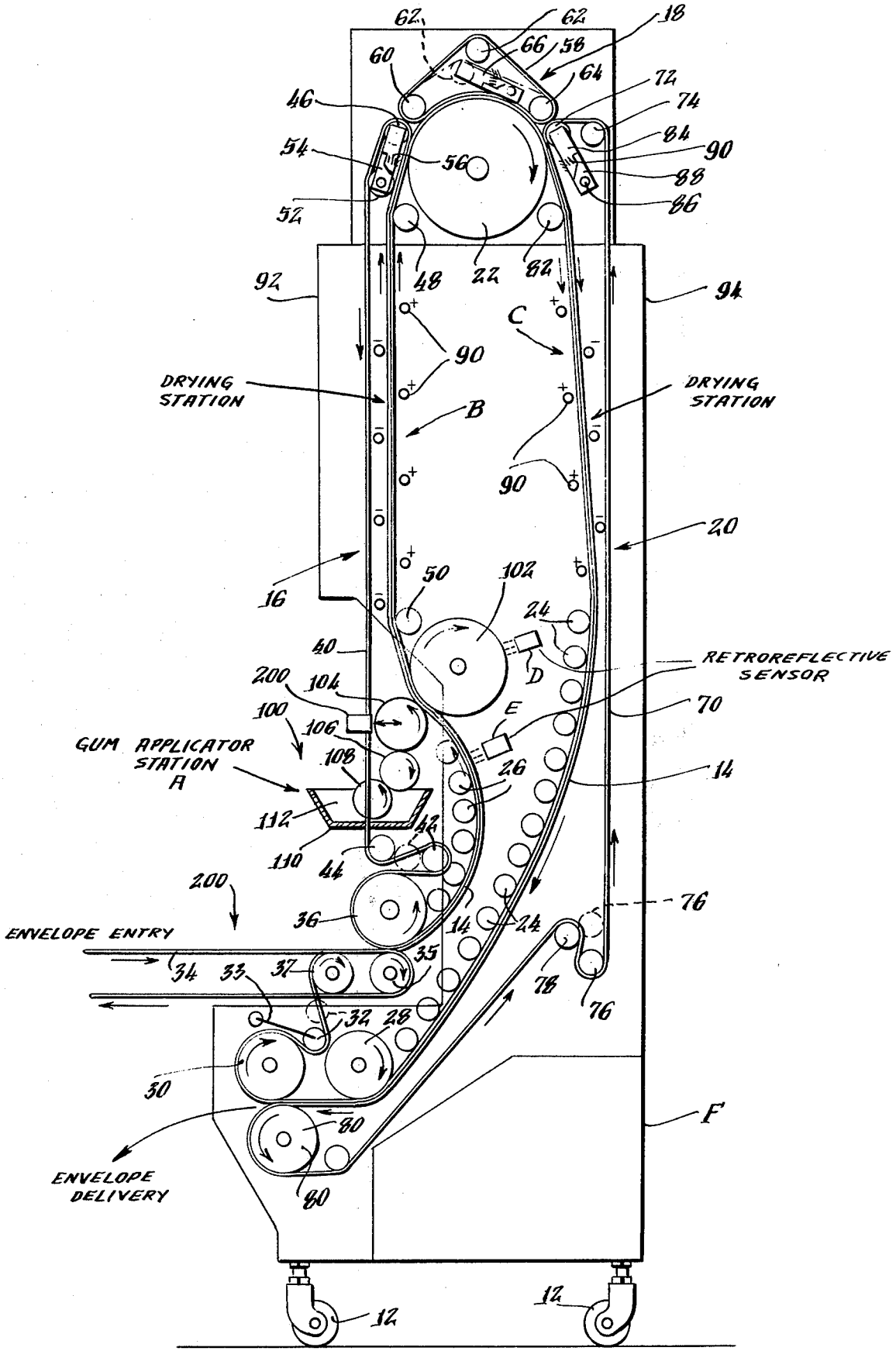
DRYING STATION
DRYING STATION
RETROREFLECTIVE SENSOR
GUM APPLICATOR STATION A
ENVELOPE ENTRY
ENVELOPE DELIVERY

APPARATUS FOR APPLYING SEALING MATERIAL TO ENVELOPES

BACKGROUND OF THE INVENTION

1. Field of the Invention

The present invention relates to an apparatus for applying sealant material such as latex or adhesive to the flap closure portion and the adjacent body portion of an envelope whereby when the latex or adhesive portions are placed in overlapping relationship and pressure is applied, the envelope may be sealed.

2. Description of the Prior Art

In U.S. Pat. No. 3,965,851 issued June 29, 1976, an apparatus for applying sealing material to envelopes is disclosed, the patent being assigned to the same assignee as the present application. The apparatus in this prior patent is designed to apply latex or adhesive to the flap closure portion and an adjacent body portion of an envelope. The apparatus disclosed in the patent constituted a significant advance in the art for achieving increased rates of production of applying sealing material to envelopes. In this apparatus, the necessity for the operator to load the blank envelopes into the apparatus at one end of the machine, and then unload the apparatus at the opposite end of the machine, whereby the speed of operation of the machine was determined by the efficiency of the operator in traversing the distance between the opposite ends of the machine, was eliminated. Rather, the envelopes were loaded onto the apparatus at one end, conveyed through the apparatus by overlapping belts which clamped the envelope therebetween and moved them through a latex application station and a drying station and then conveyed them for removal to the same end as the loading end, obtaining increased rates of production not possible theretofore.

The conveyor belts for transporting the envelope through the various stations was arranged in an overlapping triangular configuration. Adjacent the loading end of the apparatus, the overlapping belts were disassociated from each other or split so as to permit the introduction of an envelope therebetween at the commencement of the process. The belts at the loading end of the machine were each twisted about pulleys and rollers perpendicular to their normal plane of travel and separated to enable the introduction of the envelope therebetween and then they are brought back into overlapping relation. The twist implied to each belt places a great deal of strain on each belt causing them to wear more readily. The arrangement further virtually eliminates the overlapping of the belts along one side of the triangular configuration of the apparatus wasting precious space for further treatment of the envelopes, such as drying of the latex or adhesive after it has been applied.

SUMMARY OF THE INVENTION

In accordance with the present invention, a unique belt system is disclosed in an apparatus for applying sealing material to envelopes wherein the desirable features of the prior art, such as the loading and unloading of the envelopes from one location on the apparatus is retained, but the belts used to convey the envelopes through the machine are substantially coplanar and overlapped throughout the apparatus except at the loading station. This enables the envelopes to be treated, as for example, by drying the latex or adhesive at more than one location on opposite sides of the apparatus, thereby resulting in a more compact apparatus. By being able to treat the envelopes on opposite sides of the apparatus, the overall height may be reduced substantially. Further, since the belts are coplanar throughout the apparatus, strain and wear on the belts are substantially reduced. Because of the compactness which can be achieved by the unique belt system employed in the present invention, and the concomitant reduction in size, the apparatus can be rendered portable and placed on wheels to be moved from one location to another as required.

The foregoing results are achieved by supplying one or more coplanar endless inner belts which form a base support for conveying the envelope blanks through the various stations of the apparatus. Three outer, independent belt systems are also provided adjacent various portions of the upper runs of the inner belts. One run of each of the independent outer belt systems serves to clamp an envelope blank to the upper run of the inner endless support belt system providing support for the envelope blank on opposite sides of the apparatus as well as adjacent to the input and output ends of the apparatus located on the same side of the apparatus. Since support is provided on opposite sides of the apparatus for the envelope blanks, they may be treated on opposite sides of the apparatus with latex or adhesive and by drying, as required. Since the drying elements can be provided on opposite sides of the apparatus by virtue of the unique belt system employed, the apparatus can be made more compact and portable.

An envelope feed section is also provided wherein the innermost endless belt system can receive thereon the envelopes serially in regulated, sequential spaced relation. The envelopes, which are unfolded with their closure flaps ready to receive latex or adhesive along with an adjacent body portion, are fed by parallel feeder belts onto the innermost support belt system which is disposed in coplanar interleaved relation with the feed belts so that transfer of the envelope blanks is effected onto the upper support surface of the innermost endless belt system just prior to the support belt being overlapped by one of the independent outer belts, thereby effectively clamping the envelope blanks therebetween for conveyance through the apparatus.

BRIEF DESCRIPTION OF THE DRAWINGS

Further objects and advantages of the invention will become apparent from the following description and claims, and from the accompanying drawing, wherein:

The sole FIGURE is a schematic side elevational view of the apparatus for applying sealing material to envelopes comprising the subject of the present invention.

DETAILED DESCRIPTION OF THE PREFERRED EMBODIMENT

Referring now to the drawing in detail, the apparatus 10 of the present invention includes a frame F shown in phantom lines. The frame F is portable and can be mounted on castors or wheels 12.

Mounted between the sides of the frame F are various pulleys and rollers about which is entrained one or more coplanar inner endless belts 14 and overlapping one or more coplanar belt systems generally designated by the numerals 16, 18 and 20. The endless inner belt 14 comprises a support for envelopes which are conveyed through the apparatus 10.

Inner endless belt 14 is entrained about a main pulley or roller 22. Opposite runs of belt 14 are entrained about a first series of rollers 24 and a second series of rollers 26 supported between the sides of frame F. At its lower end, belt 14 is threaded about drive rollers 28 and 30 and beneath an adjustable tension roller 32. Roller 32 is mounted on an arm 33 which is pivotable as illustrated in phantom lines so as to maintain the proper tension on belt 14.

At its lower end, belt 14 is threaded in coplanar relation between one or more feeder belts 34 which deliver envelopes to the apparatus 10. The belt system 34 is the subject of our copending application Ser. No. 901333 filed concurrently herewith, whose disclosure is incorporated herein by reference. Feeder belts 34 are entrained about pulleys or rollers 35, while coplanar belt 14 is entrained about pulleys or rollers 37 upstream from the ends of feeder belts 34.

The envelopes are fed along belts 34 and transferred to coplanar belt 14 just prior to the nip of roller 36, comprising a component of a first belt system 16 having one or more coplanar belts 40 entrained thereabout and adapted to overlap the upper surface of one run of belt 14 on the left-hand side of the apparatus 10.

Belt 40 is entrained beneath an adjustable tension roller 42, adjustable as illustrated in phantom lines in the Figure to vary the tension on belt 40. Belt 40 is also entrained about a roller 44 and an upper roller 46. The other run of belt 40 is disposed in overlapping relation with the left-hand run of belt 14 which are both placed over a pulley 48, a pulley 50, and the rollers 26. A roller 52 in contact with belt 40 is mounted on the end of an arm 54 which can float against the bias of a spring 56 fixed to the side wall of frame F to dampen vibrations in belt 40.

Second belt system 18 includes one or more coplanar belts 58 entrained about idler rollers 60, 62 and 64 arranged in a substantially triangular array. The lower run of belt 58 overlaps belt 14 along the upper circumference of roller 22. Roller 62 is mounted on the end of an arm 64 pivotably supported between the side walls of frame F so as to vary the tension on belt 58. Arm 64 has a common shaft with an arm 66, one end of which rests upon a spring shock absorber 68 to dampen vibrations in the belt 58.

The third outer belt assembly 20 includes one or more coplanar endless belts 70 entrained about idler rollers 72, 74, 76, 78, a lower driven delivery cylinder 80, and the rollers 24, and a pulley 82. The inner run of belt 70 overlaps the right-hand run of belt 14, as illustrated in the sole FIGURE of the drawing. Roller 76 is vertically adjustable so as to vary the tension on belt 70. Also, roller 72 is mounted on the end of an arm 84 fixed to a shaft 86 having an arm 88 fixed thereto. An end of arm 88 contacts a vibration dampening spring 90 fixed to the frame of the machine so that any shocks imparted to belt 70 are dampened.

The inner and outer belts may take a configuration as illustrated in U.S. Pat. No. 3,965,851 so as to clamp an envelope blank therebetween and convey it throughout the apparatus 10. In use, envelopes are fed serially in unfolded condition, by belts 34 and are disposed between belt 40 and the left-hand run of belt 14. The overlapping belts 40 and 14 convey each blank through an adhesive gum or latex applicator station A and drying station B consisting of a plurality of electrical heat radiating grid elements 90 alternately positioned to the front and rear of the envelope path to form a dielectric heater. The grid elements 90 are mounted between the side walls of the frame F and accessible through a door 92. The electrical grid elements 90 are arranged in staggered array of opposite polarity on opposite sides of the envelope path to form a stray field drier to improve heating efficiency. The envelopes to which latex or adhesive has been applied and partially dried is then transferred at the upper end of apparatus 10 between belt 58 and belt 14. On the right-hand side of the apparatus, the partially dried envelopes are transferred between belt 14 and the left-hand run of belt 70 wherein they are conveyed through a second drying station C including a plurality of electrical grid elements 90 disposed behind a second door 94. The completely dried envelopes are then conveyed between the belts 70 and 14 to an exit D where they are disposed on an auxiliary conveyor and conveyed to a stacking mechanism. At station D, the belts 14 and 70 part to removal of the envelope blank. Belt 70 is entraied about driven roller or lower delivery cylinder 80 while belt 14 is entraied about the upper delivery cylinder of idler roller 30. Lower driven delivery cylinder 80 can constitute the drive roller for the lower belt 20. The upper delivery cylinder of roller 30, being gear driven by cylinder 80 can constitute the drive roller for the inner belt 14. Roller 36, being gear driven from pulleys 35 while in turn can be timing belt driven from roller 30, can constitute the drive roller for the upper belt 40. Upper transfer roller 22 being frictionally driven by belt 14 can constitute the drive by frictional contact with belt 18, of the upper, outer transfer belt system.

The adhesive or latex applicator means 100, located at Station A, is also shown in greater detail in U.S. Pat. No. 3,965,851 and per se, does not comprise a portion of the present invention. The applicator means may be connected between extensions of the frame side walls.

The applicator means 100 includes a gumming impression roller 102 in contact with the left-hand run of belt 14. Disposed opposite to the gumming impression roller 102 is a sealing material applicator roller 104. The applicator roller 104 is in contact with the right-hand run of belt 14 and the overlapped belts 14 and 40 pass between the nip of rollers 102 and 104. Disposed immediately below the sealing material applicator roller 104 are a pair of latex or adhesive transfer rollers 106 and 108 and a gum or latex box 110 containing latex or adhesive 112.

The latex applicator roller 104 includes dyes or stencils (not shown) that are contoured to stamp the desired shape of sealing material on the closure flap and adjacent body portion of each envelope prior to drying the same at drying areas B and C as the envelopes pass therebetween in the grasp of belts 14 and 40. Retroreflective sensors D and E work in conjunction to operate an applicator disengaging mechanism 200 for one revolution when an envelope is not present, to prevent application of adhesive to the impression cylinder 102.

The absence of an envelope at sensor E when sensor D senses a timing mark on cylinder 102 causes the disengaging mechanism 200 to activate moving the applicator roll 104 away from the impression cylinder.

The presence of an envelope at sensor E when the sensor E senses the timing mark on cylinder 102 releases the disengaging mechanism 200 to move the applicator roll into proper relationship to cylinder 102 to apply the adhesive to the passing envelope.

What is claimed as new is:

1. In an apparatus including roller means for applying sealing material to the facing closure flap and an adjacent body portion of an envelope, and means for drying said sealing material applied to said envelope, the improvement comprising:

means for conveying a series of said envelopes past said sealing material applicator means and said drying means, said conveying means having an envelope inlet and envelope exit and including a main endless belt forming a lower support surface for said series of envelopes, a first conveyor belt system having a run disposed in overlapping relation to a portion of a run of said endless belt for forming said inlet and receiving said series of envelopes therebetween, the overlapped runs of said endless belt and said first conveyor belt system passing between the nip of said sealing material application roller means and past said drying means to partially dry the sealing material applied by said roller means, a second conveyor belt system having a run disposed in overlapping relationship with a portion of the opposite run of said endless belt for forming said exit and receiving therebetween from the overlapped runs of said first conveyor belt system and said endless belt partially dried envelopes, the overlapped runs of said second conveyor belt system and said endless belt conveying said envelopes past said drying means to completely dry said sealing material, and a third conveyor belt system having a run disposed in overlapping relationship with a portion of said endless belt, and with each of said conveyor belt systems being guided through an endless run about a plurality of pulleys, with the axes of rotaton of said pulleys being in parallel relationship such that the runs are nontwisted, and with said third conveyor belt system being disposed between and in contacting relationship with said first and second conveyor belt systems, whereby said conveyor belt systems are positioned such that there is a substantially continuous coplanar overlap with said endless belt from said inlet to said exit of said apparatus, thereby providing for the secure conveyance of envelopes.

2. In an apparatus in accordance with claim 1 a frame mounting said endless belt and first and second conveyor belt systems, and wheel means on said frame.

3. In an apparatus in accordance with claim 1 means for feeding said envelopes in tandem to said conveyor inlet comprising said endless belt and the overlapped portion of said first conveyor belt system, said feeding means including:

transfer conveyor means having spaced coplanar belts, said transfer conveyor coplanar belts being coplanar with a portion of said endless belt which is disposed therewith.

4. In an apparatus in accordance with claim 1 means for applying tension to said first and second conveyor belt systems.

5. In an apparatus in accordance with claim 1 means for dampening vibrations imparted to the overlapped runs of said belts.

6. In an apparatus in accordance with claim 1 whrein said drying means includes electric heat applying means.

7. In an apparatus in accordance with claim 6 wherein said electric heat applying means includes:

a staggered stray field drier.

* * * * *